US009476389B2

(12) United States Patent
Amaral et al.

(10) Patent No.: US 9,476,389 B2
(45) Date of Patent: Oct. 25, 2016

(54) FUEL INJECTION SYSTEM AND PREHEATING DEVICE

(71) Applicant: Mahle International GmbH, Stuttgart (DE)

(72) Inventors: Tadeu Amaral, Sao Paulo (BR); Roberta Cruz, Taubaté (BR); Fabio Moreira, Vinhedo (BR); Juergen Stehlig, Neckartenzlingen (DE)

(73) Assignee: Mahle International GmbH (DE)

( * ) Notice: Subject to any disclaimer, the term of this patent is extended or adjusted under 35 U.S.C. 154(b) by 194 days.

(21) Appl. No.: 14/357,568

(22) PCT Filed: Nov. 9, 2012

(86) PCT No.: PCT/EP2012/072245

§ 371 (c)(1),
(2) Date: May 10, 2014

(87) PCT Pub. No.: WO2013/068526

PCT Pub. Date: May 16, 2013

(65) Prior Publication Data

US 2014/0345567 A1 Nov. 27, 2014

(30) Foreign Application Priority Data

Nov. 11, 2011 (DE) ..... 10 2011 086 201

(51) Int. Cl.
*F02M 31/02* (2006.01)
*F02M 53/02* (2006.01)
(Continued)

(52) U.S. Cl.
CPC ..... *F02M 31/02* (2013.01); *F02M 53/02* (2013.01); *F02M 53/06* (2013.01); *F02M 61/168* (2013.01);
(Continued)

(58) Field of Classification Search
CPC .. F02M 31/02; F02D 35/0053; F02D 41/003
USPC ..... 123/525
See application file for complete search history.

(56) References Cited

U.S. PATENT DOCUMENTS 5,159,915 A * 11/1992 Saito ..... F02M 31/125 123/538
5,401,935 A * 3/1995 Smith ..... F02M 57/00 219/206

(Continued)

FOREIGN PATENT DOCUMENTS

DE 1014071 B 8/1957
DE 2316054 A1 10/1974

(Continued)

OTHER PUBLICATIONS

English abstract for DE-3919589.

(Continued)

*Primary Examiner* — Lindsay Low
*Assistant Examiner* — Kevin Lathers
(74) *Attorney, Agent, or Firm* — Fishman Stewart PLLC

(57) ABSTRACT

A fuel injection system for an internal combustion engine may include at least one distributor unit to supply liquid fluid and a plurality of preheating systems each connected to the distributor unit. The respective preheating systems may have a preheating chamber and at least one heating element. A plurality of connection nozzles may each be connected to respective preheating systems. A fuel path may lead from the distributor unit through the respective preheating chambers to the respective injection nozzles of the plurality of preheating systems. The respective preheating systems may include a housing having an inlet and an outlet. The housing may be connected via a plug-in connection on the inlet to the distributor unit and via a plug-in connection on the outlet to the respective injection nozzle.

20 Claims, 10 Drawing Sheets

(51) Int. Cl.

| | |
|---|---|
| ***F02M 53/06*** | (2006.01) |
| ***F02M 61/16*** | (2006.01) |
| ***F02M 69/46*** | (2006.01) |
| ***F02M 63/02*** | (2006.01) |
| *F02M 31/125* | (2006.01) |

(52) U.S. Cl.
CPC ..... *F02M 63/0225* (2013.01); *F02M 69/465* (2013.01); *F02M 31/125* (2013.01); *F02M 2200/8015* (2013.01); *F02M 2200/8023* (2013.01); *F02M 2200/95* (2013.01)

(56) References Cited

U.S. PATENT DOCUMENTS

| | | | | |
|---|---|---|---|---|
| 2006/0000452 | A1* | 1/2006 | Tokuda | F02D 33/006 123/456 |
| 2010/0034921 | A1* | 2/2010 | Bolz | F02M 61/166 425/549 |
| 2010/0154746 | A1 | 6/2010 | Fischer et al. | |

FOREIGN PATENT DOCUMENTS

| | | | |
|---|---|---|---|
| DE | 3919589 | C1 | 5/1990 |
| DE | 19949812 | A1 | 4/2001 |
| DE | 10340159 | A1 | 4/2005 |
| DE | 102006028639 | A1 | 12/2007 |
| DE | 102009001062 | A1 | 8/2010 |
| EP | 1888910 | A1 | 2/2008 |
| EP | 2108809 | A2 | 10/2009 |
| EP | 2141348 | A1 | 1/2010 |
| FR | 2876161 | A1 | 4/2006 |
| WO | WO-2005/024225 | A1 | 3/2005 |
| WO | WO-2005/042965 | A1 | 5/2005 |
| WO | WO-2009/009846 | A1 | 1/2009 |
| WO | WO-2009/053749 | A1 | 4/2009 |

OTHER PUBLICATIONS

English abstract for DE-19949812.
English abstract for DE-10340159.
English abstract for DE-102009001062.
English abstract for DE-102006028639.
English abstract for FR-2876161.

* cited by examiner

FUEL INJECTION SYSTEM AND PREHEATING DEVICE

CROSS-REFERENCE TO RELATED APPLICATIONS

This application claims priority to German Patent Application No. 10 2011 086 201.3, filed Nov. 11, 2011, and International Patent Application No. PCT/EP2012/072245, filed Nov. 9, 2012, both of which are hereby incorporated by reference in their entirety.

TECHNICAL FIELD

The present invention relates to a fuel injection system for an internal combustion engine, particularly of a motor vehicle, with the characteristics of the general specification of claim 1. The present invention relates furthermore to a preheating system for such a fuel injection system.

BACKGROUND

Internal combustion engines which should be operated with fuel being highly viscous at low temperatures are confronted with the problem that, by using such fuels for starting the internal combustion engine, i.e. the starting of the internal combustion engine, no ignitable mix can be produced in the combustion chambers of the internal combustion engine at these low temperatures. Some biofuels, in particular biodiesel, are particularly confronted to this problem already at temperatures below +14° C. Other biofuels, e.g. ethanol and methanol, are characterized by a flash point of about +12° C., which is very high compared to the flash point of conventional gasoline of about −42° C. Consequently, such biofuels have a low volatility compared to gasoline and need a high vaporization heat compared to gasoline. These properties turn such biofuels like ethanol and methanol into critical conditions for cranking an internal combustion engine under cold conditions, since such biofuels need a large amount of heat to form an injection spray ready for ignition and for cranking the engine.

SUMMARY

This problem can be solved by two different approaches to solution: In a first approach to solution, a second fuel system can be provided to operate the internal combustion engine, allowing to operate the internal combustion engine during starting with another fuel that is easily ignitable also at low temperatures in order to thus start it. However, such a solution is very complex and accordingly expensive. Furthermore, it thus results the problem of the driver's permanently having to control two different fuel tanks or their fuel levels.

A second approach to solution is based on the general idea of preheating the fuel not readily flammable for starting the internal combustion engine. By preheating the fuel, its temperature and flammability are increased. Particularly, the viscosity is thus reduced.

From DE 101 40 071 A, a separate heating circuit for heating the fuel is known, wherein a purpose-build injector nozzle comprises an additional connection for the heating circuit. Such a solution is complex and requires relatively much space.

From DE 10 2006 028 639 A, a special injector nozzle comprising a heating system for preheating the fuel is known. Such a special injector nozzle is expensive, compared to conventional injector nozzles produced in large series.

From DE 10 2009 001 062 A, heating the fuel with heated valve air, wherein here a special injector is also required, is known.

From FR 28 76 161 A, it is known to integrate a heating system into a fuel distributor unit. Thus a comparatively big fuel volume has to be heated in order to be able to provide the preheated fuel for the starting mode. This requires comparatively much electrical energy and time.

From EP 1 888 910 B1, it is then known a categorized fuel injection system comprising a distributor unit to provide liquid fuel. Furthermore, several preheating systems comprising a preheating chamber each, comprising in turn a heating element each and being connected each to the distributor unit are provided. Besides, several injector nozzles connected each to such a preheating system are provided. It thus results a fuel path for every injector nozzle, leading from the distributor unit through the respective preheating chamber to the respective injector nozzle. In the known fuel injection system or in the known preheating system, the respective heating element is designed as a glow tip or glow plug, intruding coaxially into the respective preheating chamber. Furthermore, in the known fuel injection system, a housing comprising the respective preheating chamber of the respective preheating system is made from metal and welded to the distributor unit.

The present invention follows up on the problem of indicating a better embodiment, characterized particularly by a low-cost mountability and/or manufacturability, for such a fuel injection system or such a preheating system. Furthermore, more efficient preheating of the fuel is the aim.

According to the present invention, the object is achieved by recurring to the objects of independent claims. Favorable embodiments are the object of the dependent claims.

According to the present invention, it can now be provided that the preheating system contains a housing connected to the distributor unit via a plug-in connection on the inlet and with the respective injector nozzle via a plug-in connection on the outlet. Due to this design, the respective preheating system can be assembled particularly easily and quickly.

In an advantageous embodiment, the invention is based on the general idea that the respective heating element is generally shaped and arranged in such a way that it encloses the respective preheating chamber at least partly, preferably to at least 50% or completely. Preferably, the heating element has a hollow structure that can be circumferentially closed or circumferentially interrupted or laterally open. For example, the heating element can be designed in ring shape, particularly as an annular body, e.g. a cylindrical sleeve. Also other shapes can be appropriate like a rectangular or hexagonal shape. By using this design, a comparatively large surface of the heating element is provided for heating the preheating chamber or for heating the fuel contained in the preheating chamber. Thus, on the one hand comparatively much heat per unit of time can be incorporated into the fuel. On the other hand, the comparatively large surface of the ring-shaped heating element leads to the heat's input being distributed on a large surface and accordingly takes place relatively homogeneously in the preheating chamber. Thus, the fuel volume accumulated in the preheating chamber can be evenly tempered in a short period of time, in order to proceed to the desired starting. The fuel is preferably a biofuel and is in particular biodiesel or ethanol or methanol.

According to a favorable further development, the housing of the preheating system can be made from plastic. Preferably, it is produced from an integral, monolithic injection molded part. Thus the preheating system can be produced at a particularly cheap price.

According to another favorable embodiment, the electrical heating element can be a PTC element, "PTC" meaning "Positive Temperature Coefficient". PTC elements are characterized in that they transform electrical energy into heat, increasing at the same time their electrical resistance exponentially at a rising temperature. Thus, PTC elements can be defined as elements that are able to achieve and hold a determined temperature if voltage is connected to them. Thus, no complex electronic arrangement or control is required, as the electrical resistance of the PTC element becomes almost infinitely strong. Using such PTC elements permits the desired preheating without requiring a complex electronic control or arrangement of the heating element. In principle an electronic control can be omitted, although, an electric control of reduced complexity can be provided to control and/or to monitor the PTC element.

The system according to the invention is also robust against fuel evaporation and/or cavitation due to PTC temperature self-control. The fuel to be heated cannot pass a certain temperature limit, which has to be determined during the manufacturing process of the component. Accordingly, fuel evaporation inside the heater can be avoided and consequently also fuel cavitation in the engine can be avoided. Additionally, damage of the heater element can be prevented due to the high contact area between the PTC heating element and the fuel. This leads to a better heat transfer and indirectly protects the heating element and prevents damage. A conventional, so called "glow plug" heater has a small heating area and doesn't regulate the temperature. Therefore, such a conventional glow-plug is susceptible to damage, since it concentrates the heat in a specific small area. Compared to such a conventional heating element the risk of heater damage is reduced by the PTC heating element according to this embodiment of the invention. Furthermore, the manufacturing process is simplified compared with conventional systems, since plastic injection molding can be used to manufacture the preheating system and plug in connections can be used to attach the different components to each other. These advantages also lead to cost reduction and faster production. Due to PTC temperature self-control, the fuel to be heated cannot pass a certain temperature limit. Accordingly, self-ignition of the fuel inside of the heating element can be prevented. For example, if there is a problem with an electric connection a conventional heating element can continue to heat up the fuel until the fuel passes its ignition temperature resulting in an explosion. With the PTC technology, the PTC heating element cannot pass a certain pre-defined temperature because its self-regulating characteristics, even if the electric voltage is very high or if the electric voltage is always connected to the heating element. Finally, even with regard to voltage changes, the constant temperature mechanism of the PTC element will be effective. If the operating voltage, e.g. the battery voltage of the vehicle, increases, the PTC element initially consumes more power, and as a result, the temperature of the PTC element increases faster, and the current stabilizes faster at a lower level. Therefore, unlike a conventional glow-plug, the performance of the presented PTC heating element is not proportional to the square of the voltage as in the case of the ohm resistance. For this reason, the same PTC heating element can be used independent from the actual level of current, which can be provided, for example, at 12V DC or at 10V DC, and provides the same total power delivery or heat delivery. Because of this advantage, the PTC heating element has the possibility to be fed by the same voltage during the post cranking period. Other heaters must have the voltage lower during the post cranking period, since in this period the injection flow rate is lower compared to the cranking period under low temperatures. Consequently conventional heating elements need a complex electronic control to monitor and adjust the time that the heating element is turned on depending on the battery voltage, or even it needs a complex electronic device to get the voltage lowered before feeding the heating element during post cranking. In such a cold start systems using heating technology, the heating element usually continues to provide heat for some seconds just after the engine cranking (post crank) in order to improve drive ability and engine stabilization and to reduce pollutant emissions.

Appropriately, an inside of the ring-shaped heating element can be exposed to the fuel. In other words, the inside of the heating element turned to the preheating chamber is directly in contact with the fuel, thus permitting direct heat transmission as well.

In another embodiment, an inside of the ring-shaped heating element can limit the preheating chamber radially on the outside. Via this design, the heating element contributes to defining the preheating chamber. E.g. the heating element can thus be integrated into the structure of the housing of the preheating system.

According to another favorable embodiment, a housing of the respective preheating system can be provided with a radial inlet connected to the distributor unit and an axial outlet connected to the respective injection nozzle. The respective preheating chamber and the respective heating element are then arranged coaxially to the outlet in the respective housing. Furthermore, the respective heating element can optionally be provided with at least one radial outlet opening, through which the inlet is connected fluidly to the respective preheating chamber. This design is relatively compact and leads to an intensive integration of the heating element into the respective fuel path. Additionally, the radial or lateral inlet, in particular provided with a predetermined cross section, causes a small flow turbulence inside the preheating chamber, increasing the mixing of the cold fuel with the hot fuel. Therefore, a homogenous temperature inside the pre-heating chamber can be obtained as well as homogenous injection without temperature variations. Compared to a conventional system having an axial inlet and an axial outlet, the mixing is improved. The hot fuel tends to go to upper positions inside the pre-heating chamber or the injection valve due to density variation. This could cause heat losses, since hot fuel tends to escape to upper position and get in direct contact with cold fuel entering. Also there will be almost no turbulence in the flow. Beside the tendency to heat losses, the cold fuel entering axially the pre-heating chamber could pass directly to the injection valve, or at least the temperature distribution inside the pre-heating chamber could be inhomogeneous. Appropriately, the housing of the respective preheating system can be closed with a cap being a separate component in reference to the housing and fixed in a proofed way on the housing on an opposite side of the outlet. E.g. the cap can be welded with the housing or bonded onto it.

In another favorable embodiment, a housing of the respective preheating system can be provided with an axial inlet connected to the distributor unit and an axial outlet connected to the respective injection nozzle. In this case, the respective preheating chamber and the respective heating element in the respective housing are arranged appropriately coaxially to the inlet and outlet. Such an embodiment is characterized by a very low flow resistance, as inside of the preheating system, the fuel path is not redirected.

According to another favorable embodiment, the respective heating element can be arranged on an inside of the housing turned towards the respective preheating chamber of the respective preheating system. Thus, it is possible to limit the preheating chamber using the heating element or cause a direct contacting between the heating element and the fuel.

Alternatively, it is also possible to arrange the respective heating element on an outside of a housing turned away from the respective preheating chamber of the preheating system. In this case, it can e.g. be renounced to a protective cover or a protective coating that has to be applied to the heating element if a fuel with corrosive effect to the material of the heating element is used and the heating element gets into direct contact with the fuel.

In another alternative embodiment, the respective heating element can be integrated in a wall enclosing the respective preheating chamber of a housing of the respective preheating system. E.g. the respective heating element can therefore already be applied to the respective injection mold during injection into the injection mold, so that the heating element is integrated into the plastic of the housing. In this case, the heating element is protected against the fuel as well as the surrounding air, being inside of the material of the wall. At the same time, the heating element is thus positioned in the housing at a low price.

Another advantageous embodiment can provide that the respective housing incorporate a separating wall that encloses the respective preheating chamber, wherein at least one such heating element is radially arranged between the separating wall and a wall of the housing. The respective housing wall can here enclose the referenced separating wall. Using such a separating wall makes it possible to avoid direct contact between the fuel and heating element. For example, this can significantly reduce the danger of corrosion on the heating element. The separating wall can also be made out of a thermally conductive material, i.e., a material distinguished by an especially good thermal conductivity. For example, the separating wall can exhibit a better thermal conductivity than the housing wall. The separating wall can be made out of aluminum or copper, or out of an aluminum alloy or copper alloy, for example. The separating wall can be geometrically adjusted to the respective preheating chamber. In a cylindrical preheating chamber, the separating wall is appropriately also cylindrical or tubular in design. In order to prevent the respective heating element from coming into contact with creeping fuel, at least one seal can also be provided, which is radially arranged between the separating wall and the housing wall. Such seals can appropriately be provided on either side of the respective heating element.

Alternatively, it can also be provided that the respective housing again incorporate such a separating wall that encompasses the respective preheating chamber, wherein in this case at least one such heating element is arranged inside the separating wall, and separated both from the fuel and from a wall of the housing that encloses the separating wall. This makes it especially easy to realize an encapsulated and hermetically sealed accommodation of the respective heating element in the separating wall, so that the respective heating element is reliably protected against contact with the fuel. In particular, the separating wall with the integrated, at least one heating element can form a preassemblable unit, which is particularly easy to incorporate into the housing. For example, this separating wall can be conceived in two parts, and have a thermally conductive inner part and a thermally insulating outer part, between which the respective heating element is arranged. In particular, the materials can here be selected in such a way that the thermal conductivity is greater for the outer part than for the housing wall, and less for the inner part than for the housing wall.

According to another appropriate embodiment, the fuel injection system can be provided with only one injection nozzle for each cylinder of the internal combustion engine. That means that the respective preheating system is assigned to this one injection nozzle at the respective cylinder. It thus results a particularly cheap embodiment for the fuel injection system.

On the contrary, in another embodiment, it can be provided that the fuel injection system features an operating nozzle and a cold start nozzle for each cylinder of the internal combustion engine, wherein the injection nozzle assigned to the respective preheating system is formed by the respective cold start nozzle. In this case, two injection nozzles that in particular can be different from one another are used per cylinder to permit an optimization for cold start or hot operation.

According to another embodiment, the respective preheating chamber can feature a preheating volume to incorporate a fuel quantity that is sufficient at a cold start of the internal combustion engine for at least one injection of the respective injection nozzle and for a maximum of two injections of the respective injection nozzle. As a result, the respective preheating chamber has a relatively limited volume, so that by using the heating element, the fuel accumulated inside of the preheating chamber can be heated to the desired temperature in a short period of time.

Another embodiment can provide that the respective heating element annularly encloses the respective preheating chamber, in particular completely. This makes it possible to realize a symmetrical introduction of heat in the circumferential direction. Alternatively, it is conceivable that several heating elements be used for each preheating chamber, which are distributed in the circumferential direction and each extend over only a small circumferential segment, e.g., over about 30°. In particular, these heating elements can also be given a flat design, which makes them especially simple and low-cost to manufacture. These heating elements are also particularly easy to accommodate in corresponding flat recesses in the housing wall and/or in the aforementioned separating wall.

Another embodiment can provide that the plug-in connection on the inlet and/or the plug-in connection on the outlet be designed as a bayonet coupling. In the respective plug-in connection, a plugging movement oriented in an axial plugging direction is in this case coupled with a rotational movement around a rotational axis oriented parallel to the plugging direction, so as to establish or detach the respective plug-in connection. Such bayonet couplings are especially easy to equip with a safeguard against unintended opening. For example, turning activates a safeguard against pulling out the components inserted one into the other. Alternatively, pure plug-in connections can be provided, which can optionally be equipped with an additional safeguard against unintended opening or removal of the plugged components.

In a preheating system according to the invention, an inlet to connect the preheating system to a distributor unit, an outlet to connect an injection nozzle to the preheating system, a preheating chamber and a heating element which is designed as an annular body and encloses the preheating chamber are provided. Inside of the respective preheating system, a fuel path leads from the inlet through the preheating chamber to the outlet. Thus such a preheating system is characterized by a compact design, a reduced energy need and a short preheating time.

Other important characteristics and advantages of the invention result from the sub claims, from the drawings and from the associated descriptions of the figures based on the drawings.

It goes without saying, that the above mentioned characteristics and the characteristics still to be explained below cannot only be used in the respectively indicated combination, but also in other combinations or by themselves without leaving the frame of the present invention.

Preferred examples of embodiments of the invention are presented in the drawings and will be further explained in the following description, wherein identical references refer to identical or similar or functionally identical components.

BRIEF DESCRIPTION OF THE DRAWINGS

Schematically, the figures show the following aspects.

DETAILED DESCRIPTION

Figure 1:
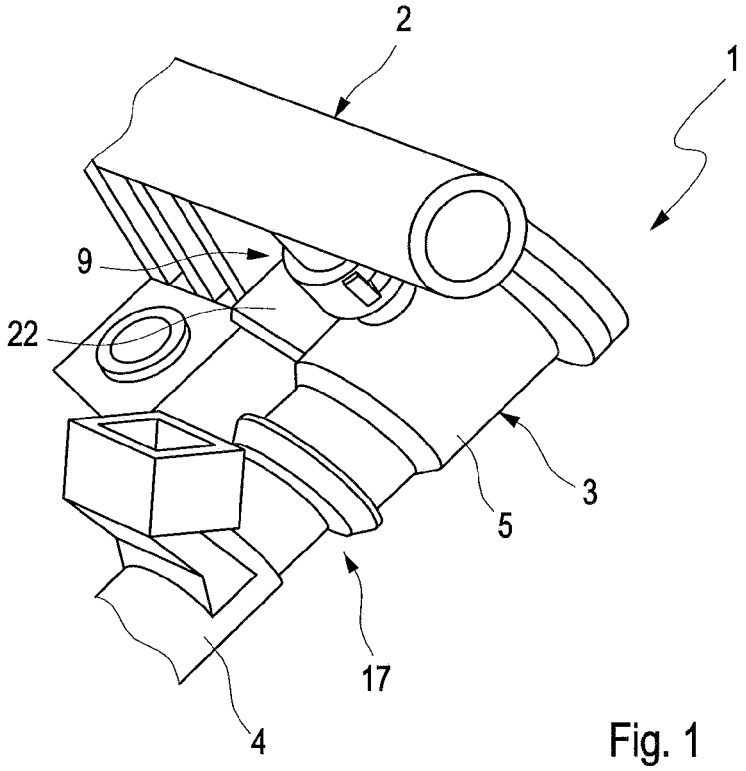
FIG. 1 Shows an isometric view of a fuel injection system close to an injection nozzle, FIG. 2 Shows a section view of the fuel injection system close to a preheating system, FIG. 3 Shows a pulled drawing of the preheating system, FIG. 4 Shows a pulled drawing of the fuel injection system close to the preheating system, FIG. 5 Shows a section view of the preheating system in another embodiment, FIGS. 6-10 Show a highly simplified section view of the fuel injection system close to the preheating system in different embodiments.

According to FIGS. 1 to 14, a fuel injection system 1 serving an internal combustion engine not displayed here to supply the combustion chambers of the internal combustion engine with fuel comprises at least one distributor unit 2, several preheating systems 3 and several injection nozzles 4. The distributor unit 2, which can also be called "rail" or "common rail" serves to provide liquid fuel. The respective preheating system 3 has a housing 5 and comprises a preheating chamber 6 and features a heating element 7. The preheating system 3 is connected to the distributor unit 2. One injection nozzle 4 is connected to such a preheating system 3 respectively. Inside of the fuel injection system 1, for every injection nozzle 4, an outlined fuel path 8, leading from the distributor unit 2 through the respective preheating chamber 6 to the respective injection nozzle 4, is represented with arrows in FIGS. 2 and 5 to 10.

The heating element 7 in the embodiments of FIGS. 1 to 12 is designed in an annular shape, completely enclosing the respective preheating chamber 6. In the example in FIGS. 1 to 12, the heating element 7 is an annular body with a circular shape or a cylindrical or preferably a circular cylindrical body. It is also imaginable for the annular-shaped heating element 7 to enclose the preheating chamber 6 in the circumferential direction on less than 360°, but at least on more than 180°.

Figure 13:
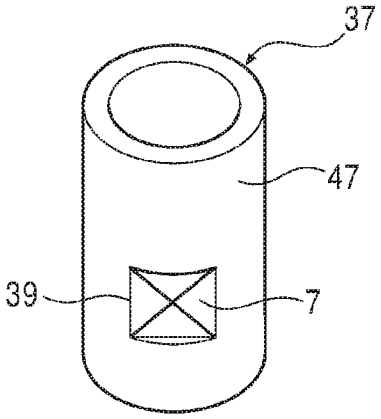
FIGS. 13, 14 Show a respective highly simplified, isometric view of a separating wall with recesses for incorporation of heating elements.
Figure 14:
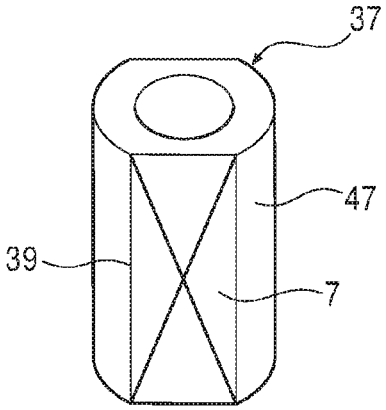

By contrast, in the embodiments of FIGS. 13 and 14, the respective heating element 7 is conceived in such a way as to extend in the circumferential direction over only a comparably small region, for example which can lie between 15° and 45°. In addition, the respective heating element 7 can in these cases have a flat or planar design, making it especially easy to manufacture. In addition, several heating elements 7 can be used for each preheating chamber 6, which are appropriately distributed symmetrically in the circumferential direction. In the embodiments of FIGS. 13 and 14, for example, each preheating chamber 6 is provided with a respective two heating elements 7, which are situated diametrically opposite each other.

According to FIGS. 1 to 12, the housing 5 of the preheating system 3 is connected to the distributor unit 2 via a first plug-in connection 9 or one arranged on the inlet. In the example, on the housing 5 a muzzle 10 that can be plugged into a plug 11 integrally formed at the distributor unit 2 is therefore formed integrally. The muzzle 10 has a seat ring 12, integrated in a corresponding ring groove 13. The plug-in connection on the inlet 9 is secured by a safety clamp 14 passing through the socket 11 in sideway cuts 15 and the muzzle 10 in a ring groove 16.

The housing 5 is furthermore connected via a second or plug-in connection on the outlet 17 with the respective injection nozzle 4. In the example, the injection nozzle 4 has a muzzle 18, plugged into a socket 19 integrally formed on the housing 5. Appropriately the muzzle 18 at the nozzle has a seal 20, arranged in a corresponding ring groove 21.

Both plug-in connections 9 and 17 are here conceived as pure plug-in connections 9,17, in which the components to be plugged are each only plugged in one plugging direction, so as to establish the plug-in connection 9, 17. The two plugging directions of the two plug-in connections 9, 17 in this case extend inclined relative to each other in the variants in FIGS. 1 to 5, 11 and 12, here by about 90°, and parallel to each other in the variants in FIGS. 6 to 10. Alternatively, it is also possible to conceive at least one of the plug-in connections 9, 17 as a bayonet coupling, in which the plugging movement is combined with a rotational movement, for example to secure the plugged components in the extraction direction of the plug-in connection 9, 17.

The housing 5 is favorably formed as a monolithic plastic piece. Appropriately, the housing 5 is formed by injection molding.

Preferably, the heating element 7 is a PTC element. A corresponding electrical supply or power supply of the heating element 7 is facilitated via an electrical port 22, formed on the housing 5. In the embodiments of the FIGS. 1 to 7, 9 and 10, the heating element 7 is integrated or arranged into the housing 5 in such a way that an inside 23 of the heating element 7 is exposed directly to the fuel. In particular, in these cases the inside 23 of the heating element 7 forms a radial limit to the preheating chamber 6 against the outside.

Figure 2:
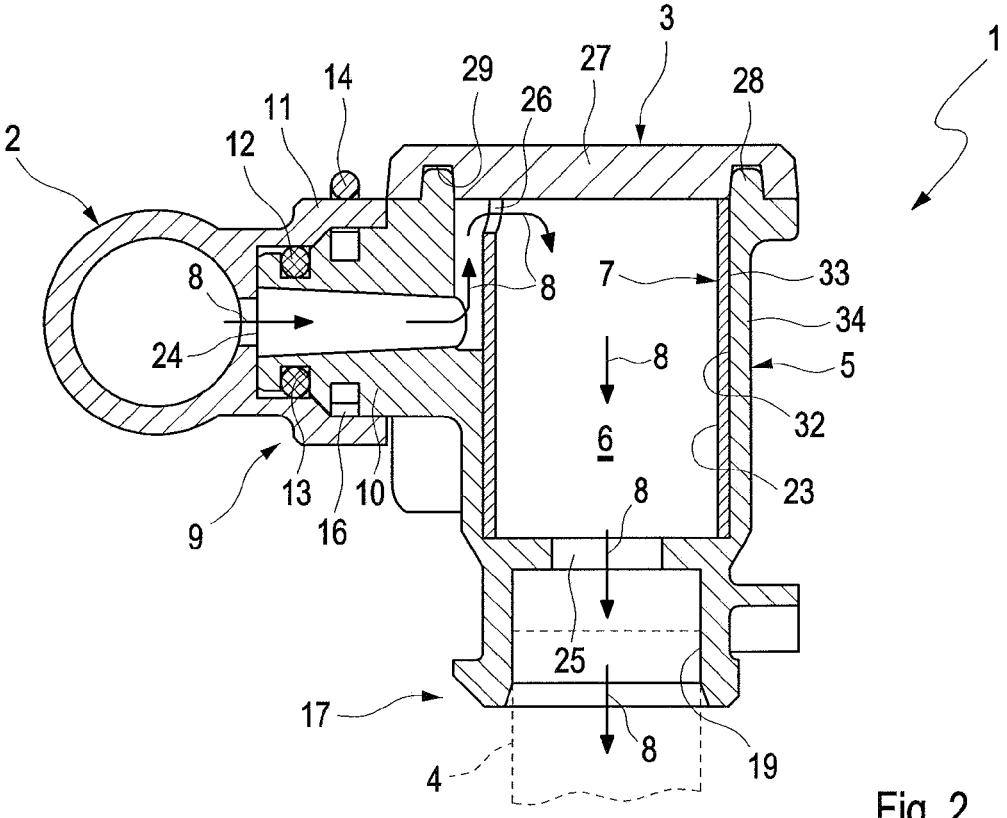
Figure 3:
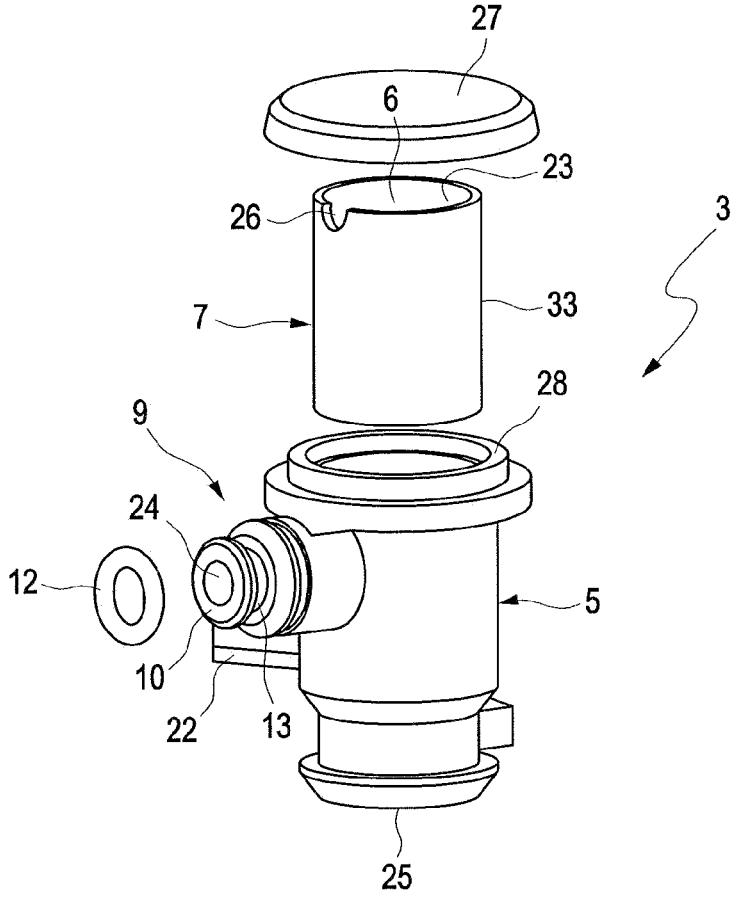
Figure 4:
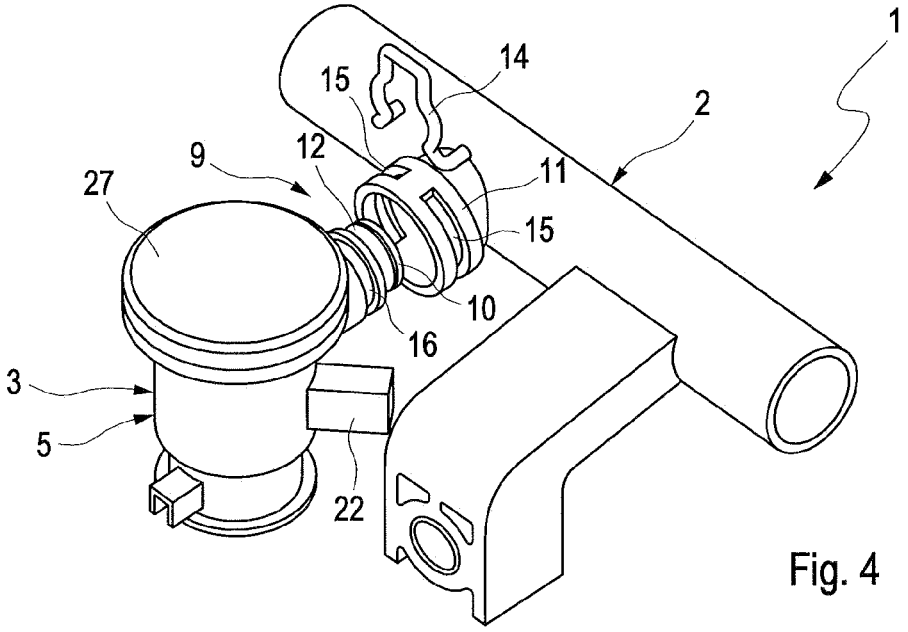
Figure 5:
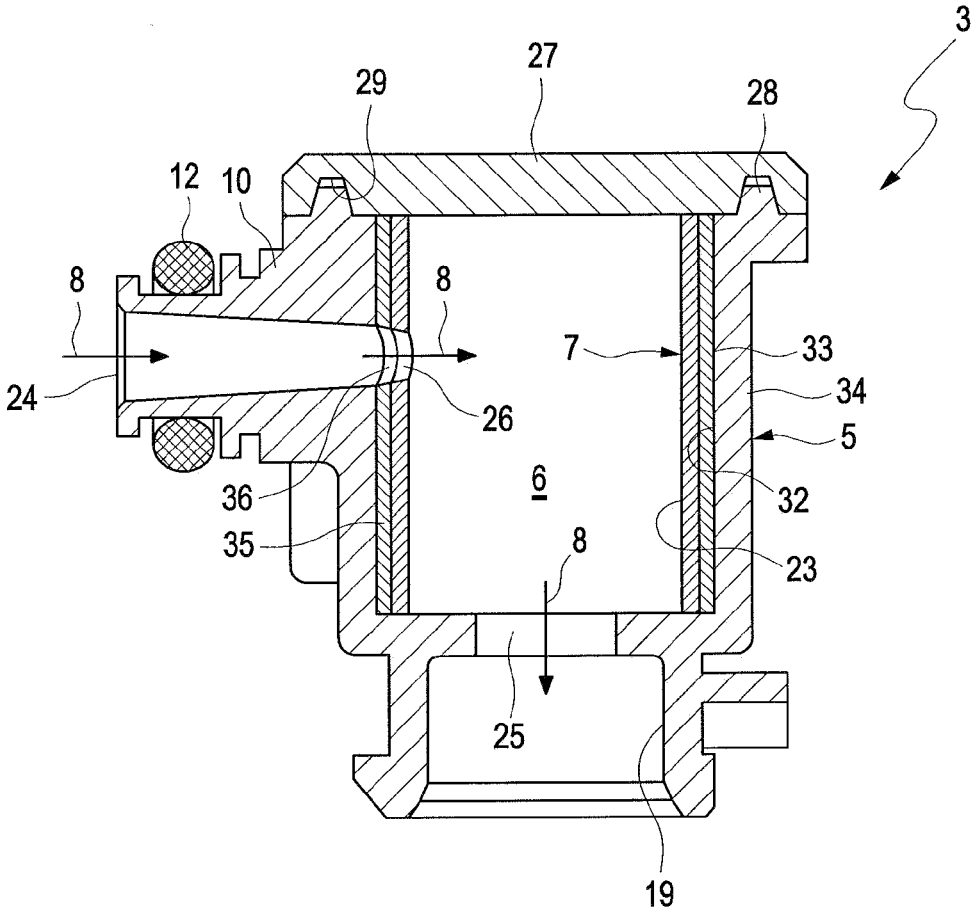
Figure 6:
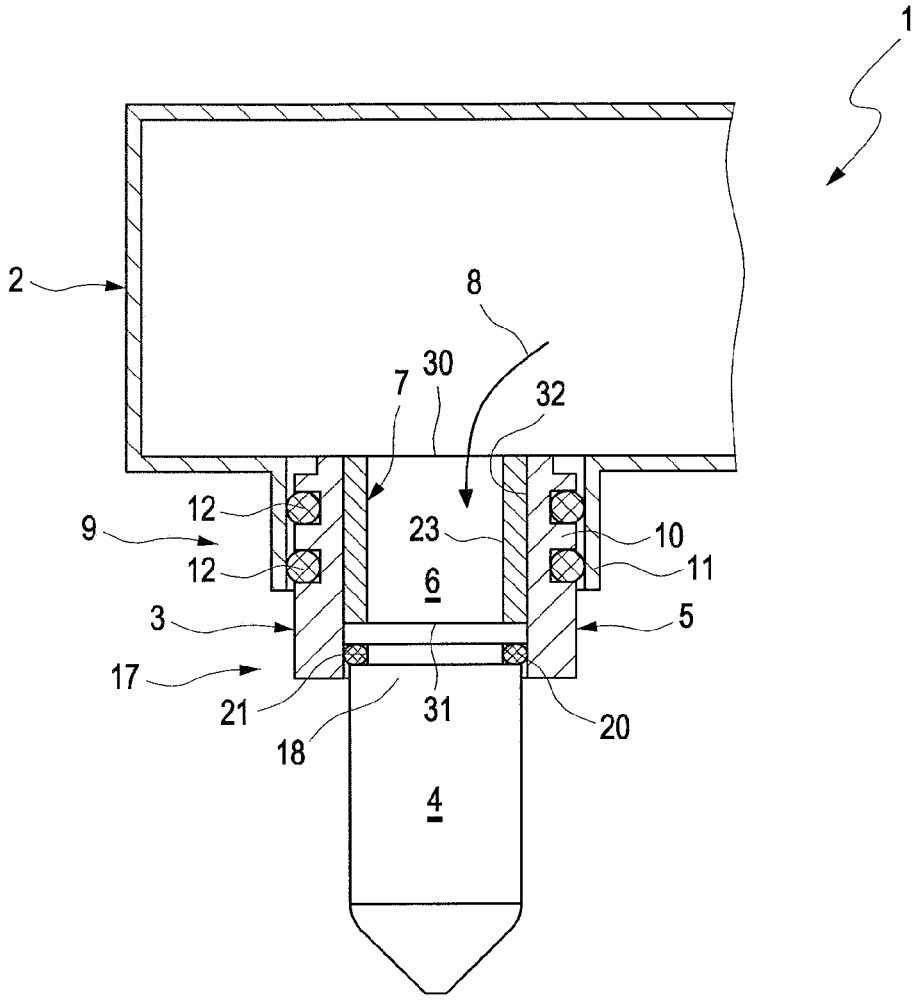
Figure 7:
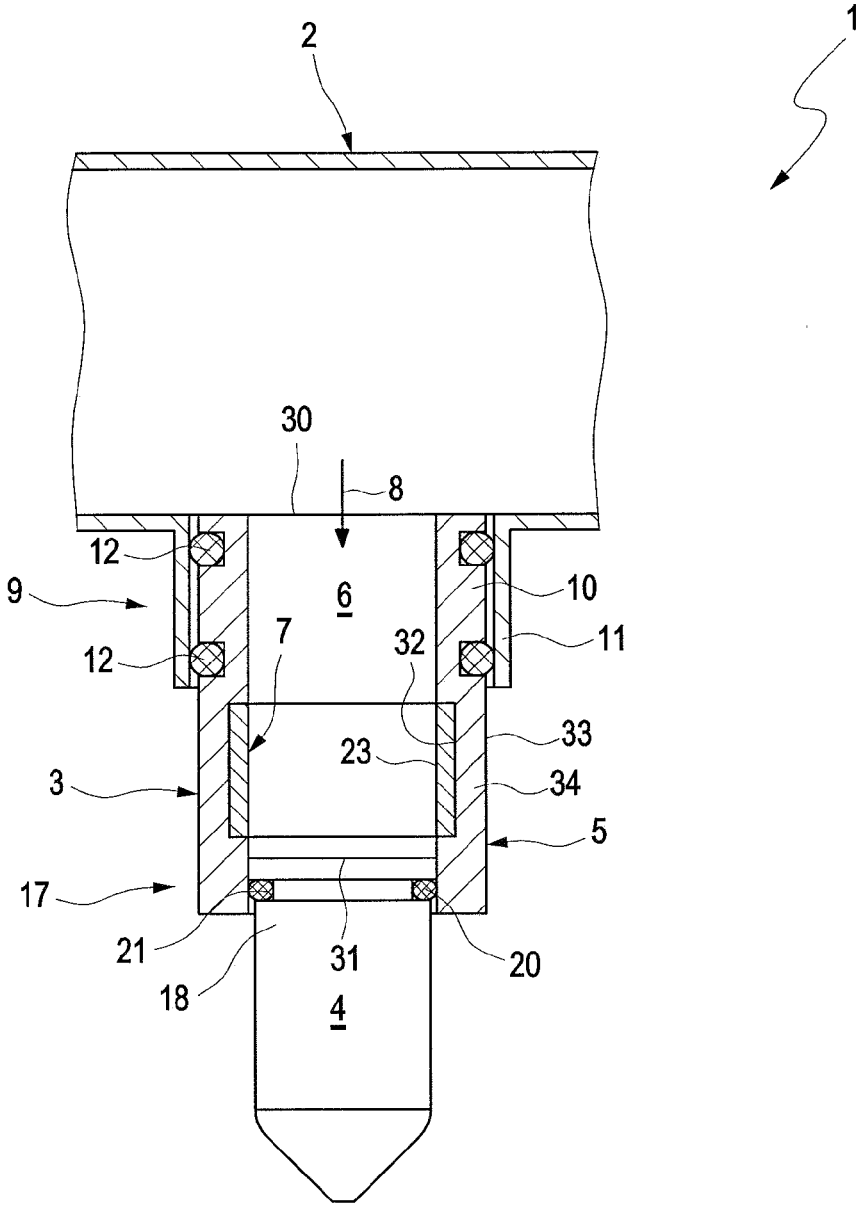

In the embodiment represented in FIGS. 1 to 5, the housing 5 is provided with a radial inlet 24 connected to the distributor unit 2, and an axial outlet 25 connected to the respective injection nozzle 4. The preheating chamber 6 and the respective heating system 7 are arranged coaxially to the outlet 25 in the housing 5. The heating element 7 is provided with at least one radial inlet opening 26 connecting the inlet 24 to the preheating chamber 6 fluidly. The housing 5 is closed axially opposite of the outlet 25 with a cap 27 therefore appropriately welded to the housing 5. Appropriately, therefore it can be provided an axially out-standing, annular-shaped collar 28 on the housing 5, rising up into a complementary annular groove 29, formed on the cap 27. The interaction of collar 28 and annular groove 29 simplifies producing a sufficiently solid and sufficiently sealed connection via glue or via a welded connection. In the embodiment of FIG. 2 the inlet 24 and the inlet opening 26 are offset in the axial direction, therefore, the fuel path 8 comprises two 90° turns between the inlet 24 and the inlet opening 26. In contrast thereto, FIG. 5 depicts an embodiment, in which the inlet 24 and the inlet opening 26 are aligned to each other, therefore, the fuel path 8 is straight from the inlet 24 to the inlet opening 26 and has a reduced flow resistance. Additionally, the embodiment of FIG. 5 discloses a thermal insulator 35 arranged radially between the heating element 7 and the housing 5. Preferably, the shape of the thermal insulator 35 is adapted to the shape of the heating element 7 such that the thermal insulator 35 encloses circumferentially the heating element 7. Additionally, the thermal insulator 35 also has an opening 36 aligned to the inlet opening 26 of the heating element 7.

In contrast, FIGS. 6 to 9 respectively show an embodiment where the housing 5 is provided with an axial inlet 30 connected to the distributor unit 2 and an axial outlet 31 connected to the respective injection nozzle 4, wherein the preheating chamber 6 and the heating element 7 in the housing 5 are arranged or oriented coaxially to the inlet 30 and coaxially to the outlet 31.

Figure 8:
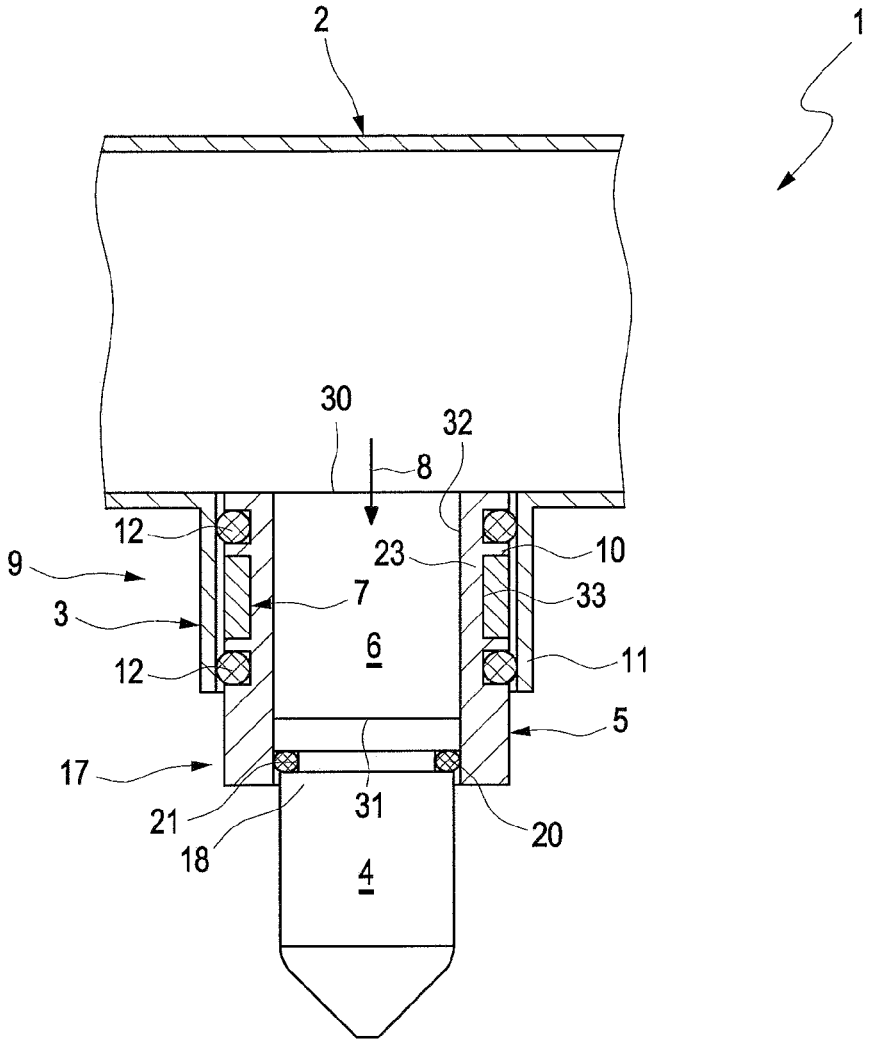
Figure 9:
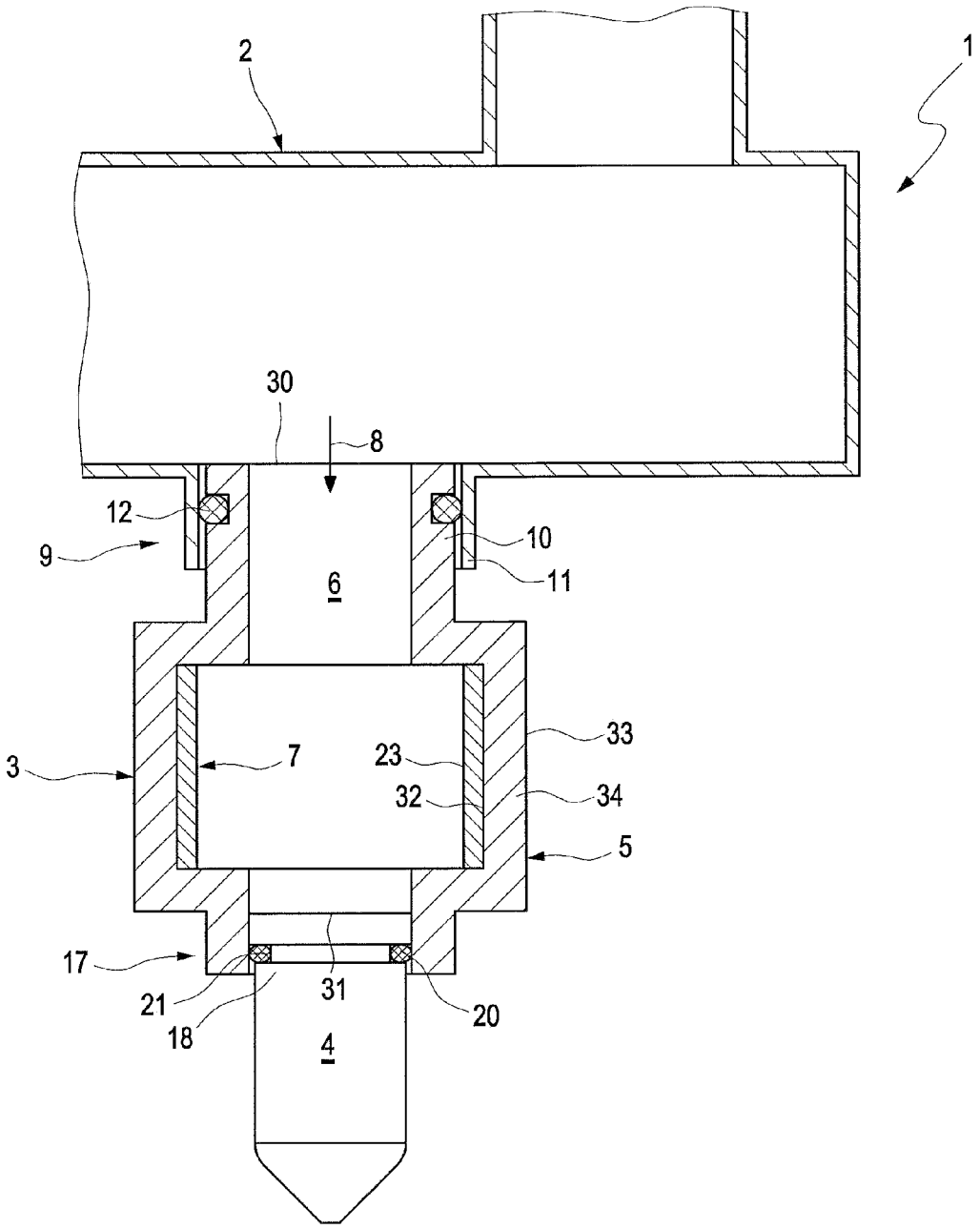

In the embodiments of FIGS. 1 to 7, 9 and 10, the respective heating element 7 is arranged on an inside 32 of the housing 5, turned to the preheating chamber 6. In contrast, FIG. 8 shows an embodiment in which the heating element 7 is arranged on the outside 33 of the housing 5, which is turned away from the preheating chamber 6. In the example of FIG. 8, the heating element 7 is arranged near the muzzle 10. It thus results a particularly compact and axially short building embodiment, in which the heating element 7 and the preheating chamber 6 are integrated into the plug-in connection 9 on the inlet.

Alternatively, it is also possible to integrate the respective heating element 7 into a wall 34 of the housing 5, which encloses the preheating chamber 6. E.g. the annular-shaped heating element 7 can be enclosed in the plastic of the housing 5 or the respective wall 34, so that the heating element 7 is radially embedded inside and radially embedded outside into the plastic of the housing 5.

Figure 11:
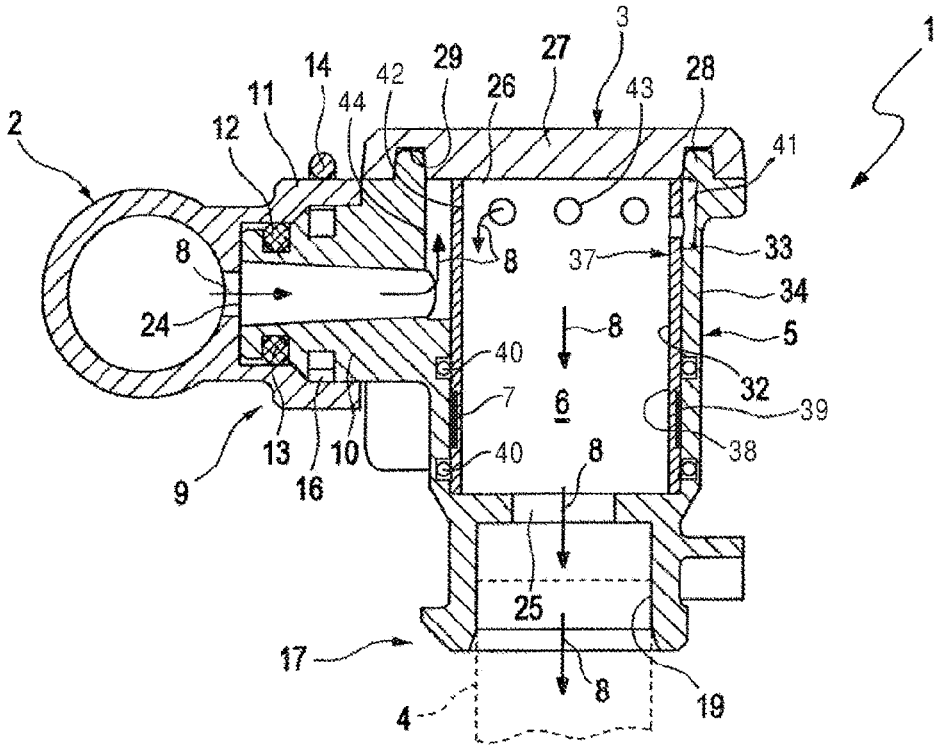
FIG. 11 Shows a view as in FIG. 2, but for another embodiment.
Figure 12:
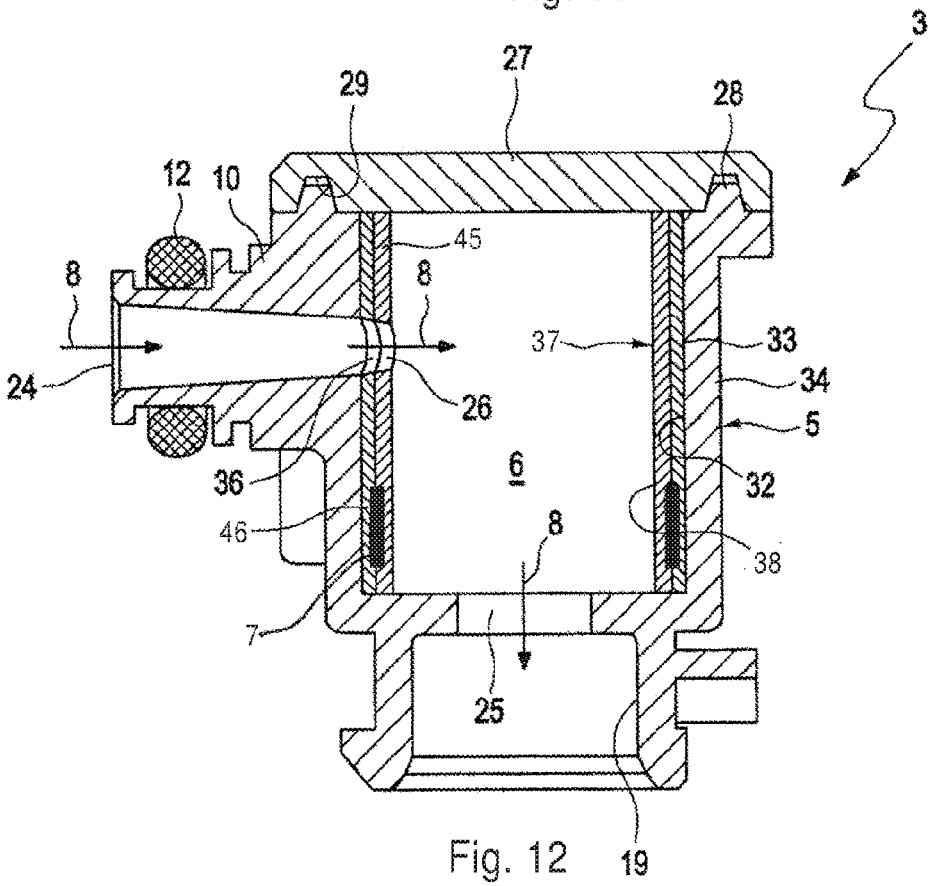
FIG. 12 Shows a view as in FIG. 5, but for another embodiment.

In order to prevent direct contact between the respective heating element 7 and the fuel in the respective preheating chamber 6, the special embodiments in FIGS. 11 and 12 are provided with a separating wall, which is incorporated into the housing 5 in such a way as to enclose the respective preheating chamber 6 in the circumferential direction, preferably in a self-contained manner. As a consequence, an inside 38 of the separating wall 37 facing the preheating chamber is exposed to the fuel. The separating wall 37 is appropriately made out of a corrosion-resistant material in relation to the fuel. The respective heating element 7 is now protected against direct contact with the fuel by means of the separating wall 37.

According to FIG. 11, the respective heating element 7 is radially arranged between the separating wall 37 and wall 34 of the housing 5, which in the following can also be referred to as housing wall 34. A recess 39 can appropriately be provided on an outside 47 of the separating wall 37 and/or on the inside 32 of the housing wall 34 to enable a recessed accommodation of the heating element 7. Also provided axially on either side of the annular heating element 7 in FIG. 11 are two seals 40, which extend in the circumferential direction, and are designed as O-rings, for example. As a result, the heating element 7 can be sealed away from the fuel, which creeps through the gaps between the housing wall 34 and separating wall 37.

In the example in FIG. 11, the separating wall 37 extends axially over the entire height of the preheating chamber 6. An annular groove 41 can be incorporated distally to the outlet 25 on the inside 32 of the housing wall 34, preferably extending in a self-contained manner in the circumferential direction. This annular groove 41 is covered or sealed by an axial section 42 of the separating wall 37. In this axial section 42, the separating wall 37 has several outlet openings 43, which appropriately are symmetrically distributed in the circumferential direction. The annular groove 41 communicates with the inlet 24 by way of an axial groove 44, which is also designed on the inside 32 of the housing wall 34. As a consequence, the fuel can flow radially through the outlet openings 43 into the preheating chamber 6.

The separating wall 37 preferably consists of a material whose thermal conductivity is greater than that of the material comprising the housing wall 34.

In the embodiment shown in FIG. 12, the respective heating element 7 is integrated into the separating wall 37, in such a way that the respective heating element 7 is located inside the separating wall 37. To this end, the separating wall 37 can have a two-part, radial design, so that it exhibits a radially inner part 45 lying on the inside, and a radially outer part 46 lying on the outside, which are arranged coaxially one inside the other. The respective heating element 7 is now situated radially between the inner part 45 and outer part 46. The inner part 45 and outer part 46 can be tightly joined together in a suitable manner, e.g., via an adhesive bond. This tightly encapsulates the respective heating element 7 in the separating wall 37, and protects it against contact with fuel.

The inner part 45 preferably consists of a material whose thermal conductivity is greater than that of the material comprising the housing wall 34. By contrast, the outer part 46 can preferably consist of a material whose thermal conductivity is less than that of the material comprising the housing wall 34, so that the outer part has a thermally insulating effect.

In the configuration selected in FIG. 12, the separating wall 37 contains the outlet opening 26 already described above with reference to FIG. 5, which is axially aligned with the inlet 24. The various embodiments for the separating walls 37 according to FIGS. 11 and 12 can clearly also be used in the other embodiments in FIGS. 1 to 5 and 6 to 10, to the extent reasonable.

The dimensioning of the preheating chamber 6 is made appropriately in such a way that the preheating chamber 6 has a preheating volume to incorporate a quantity of fuel that is sufficient at a cold start of the internal combustion engine to perform at least one injection of the respective injection nozzle 4 and at maximum two injections of the respective injection nozzle 4.

Appropriately, the fuel injection system 1 is provided with only one injection nozzle 4 for each cylinder of the internal combustion engine. Generally, in an alternative embodiment, it can be provided for the fuel injection system 1 to have two injection nozzles for each cylinder of the internal combustion engine, that is an operating nozzle and a cold start nozzle. In this case, the injection nozzle 4 assigned to the respective preheating system 3 is formed by the respective cold start nozzle.

Figure 10:
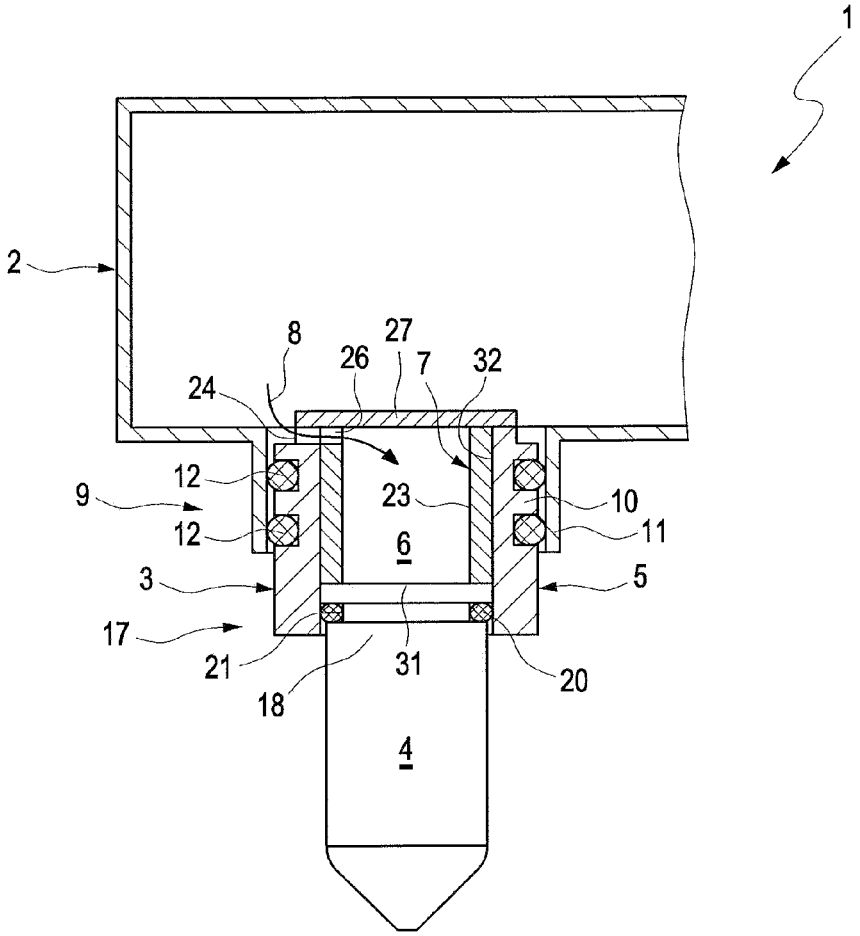

Finally, FIG. 10 shows another embodiment, which is a combination of the embodiments of FIG. 6 and FIG. 2 or 5 or FIG. 11 or FIG. 12. Therefore, the housing 5 is provided with the cap 27 to axially close the pre-heating chamber 6. Also the housing 5 is provided with the radial inlet 24 and the heating element 7 is provided with the radial inlet opening 26. Therefore, the fuel path 8 has a predetermined flow resistance providing flow conditions improving mixing of incoming cold fuel with already heated fuel. It is self-explaining that these features of the embodiment of FIG. 10 also can be realized with the embodiments of FIGS. 7 to 9.

According to FIGS. 13 and 14, the specified recess 39 can be designed to accommodate the respective flat heating element 7 in the outside 47 of the separating wall 37 or in an outside of the inner part 45 of the separating wall 37, e.g., in the form of a flat area. According to FIG. 13, the respective heating element 7 can extend over a comparatively small axial area of the separating wall 37. In contrast, FIG. 14 shows an embodiment in which the respective heating element 7 extends over the entire axial height of the separating wall 37.

The invention claimed is:

1. A fuel injection system for an internal combustion engine, comprising:

at least one distributor unit to supply liquid fuel, a plurality of preheating systems each connected to the distributor unit, the respective preheating systems having a preheating chamber and at least one heating element, a plurality of injection nozzles each connected to respective preheating systems, wherein a fuel path leads from the distributor unit through the respective preheating chambers to the respective injection nozzles, wherein the respective preheating systems comprises a housing having an inlet and an outlet, wherein the housing is connected via a plug-in connection on the inlet to the distributor unit and via a plug-in connection on the outlet to the respective injection nozzle;

wherein the at least one heating element of at least one preheating system is arranged coaxially in the preheating chamber, and wherein an inside of the at least one heating element delimits the preheating chamber radially relative to the fuel path and contains the fuel path radially inside of the at least one heating element.

2. The injection system according to claim 1, wherein the respective heating elements at least partially enclose the respective preheating chamber.

3. The injection system according to claim 1, wherein the respective housings are made of plastic.

4. The injection system according to claim 1, wherein the heating element is a PTC element.

5. The injection system according to claim 1, wherein the inside of the heating element is exposed to the fuel path.

6. The injection system according to claim 1, wherein:

the housing inlet and outlet of the respective preheating systems include a radial inlet connected to the distributor unit and an axial outlet connected to the respective injection nozzle, respectively, the respective preheating chambers and the respective heating elements are arranged in the respective housing coaxially to the outlet, and wherein the respective heating elements include at least one radial inlet opening via which the inlet is connected fluidly to the respective preheating chamber.

7. The injection system according to claim 1, wherein:

the housing inlet and outlet of the respective preheating systems include an axial inlet connected to the distributor unit and an axial outlet connected to the respective injection nozzle, respectively, and the respective preheating chamber and the respective heating element are arranged coaxially to the inlet and the outlet in the respective housing.

8. The injection system according to claim 1, wherein at least one heating element is arranged on an inside of the housing of at least one respective preheating system, the at least one heating element oriented towards the respective preheating chamber.

9. The injection system according to claim 1, wherein at least one heating element is arranged on an outside of the housing of at least one respective preheating system, the at least one heating element oriented away from the respective preheating chamber.

10. The injection system according to claim 1, wherein at least one heating element is integrated into a wall of the housing of at least one respective preheating system, the wall enclosing the respective preheating chamber.

11. The injection system according to claim 1, wherein at least one housing includes a separating wall that encloses the respective preheating chamber and a radially spaced wall disposed away from the respective preheating chamber, wherein at least one associated heating element is arranged between the separating wall and the wall of the at least one housing.

12. The injection system according to claim 1, wherein at least one housing includes a separating wall that encloses the respective preheating chamber, wherein at least one associated heating element is integrated into the separating wall such that the at least one heating element is arranged inside the separating wall.

13. The injection system according to claim 1, wherein the number of injection nozzles equals a number of cylinders of the internal combustion engine.

14. The injection system according to claim 1, comprising an operating nozzle and a cold start nozzle corresponding to each cylinder of the internal combustion engine, wherein the injection nozzle associated with the respective preheating system comprises the respective cold start nozzle.

15. The injection system according to claim 1, wherein the respective preheating chambers include a preheating volume to accommodate a quantity of fuel sufficient for up to two injections of the liquid fuel from the respective injection nozzle at a cold start of the internal combustion engine.

16. The injection system according to claim 1, wherein the respective heating element annularly encloses the respective preheating chamber.

17. The injection system according to claim 1, wherein at least one of the plug-in connections on the inlet and outlet of the respective preheating systems are configured as a bayonet coupling.

18. A fuel injection system for an internal combustion engine, comprising:

at least one preheating assembly including a preheating chamber and at least one annular heating element at least partially enclosing the preheating chamber in a circumferential direction, the preheating assembly having a housing defining an inlet and an outlet;

a distributor unit coupled to the at least one preheating assembly via the inlet, the distributor unit configured to supply a liquid fuel to the at least one preheating assembly;

an injection nozzle coupled to the at least one preheating assembly via the outlet;

wherein the housing of the at least one preheating assembly couples to the distributor unit via an inlet plug-in connection and couples to the injection nozzle via an outlet plug-in connection, and a fuel path leads from the distributor unit through the preheating chamber to the injection nozzle;

wherein the inlet of the housing includes a radial inlet connected to the distributor unit configured to direct the liquid fuel radially to the preheating chamber and the outlet of the housing includes an axial outlet connected to the injection nozzle; and wherein the preheating chamber and the at least one heating element are arranged in the housing coaxially to the outlet.

19. The fuel injection system according to claim 18, wherein the radial inlet of the housing is arranged axially offset from an inlet opening of the at least one heating element so that the at least one heating element redirects the liquid fuel along the flow path.

20. A fuel injection system for an internal combustion engine, comprising:

a distributor unit to supply a liquid fuel;

a preheating system connected to the distributor unit, the preheating system having a preheating chamber and a heating element;

an injection nozzle connected to the preheating system, wherein a fuel path leads from the distributor unit through the preheating chamber of the preheating system to the injection nozzle;

wherein the preheating system includes a housing having an inlet and an outlet, wherein the housing is connected via a plug-in connection on the inlet to the distributor unit and via a plug-in connection on the outlet to the injection nozzle;

wherein the inlet of the housing includes a radial inlet connected to the distributor unit and the outlet of the housing includes an axial outlet connected to the injection nozzle;

wherein the preheating chamber and the heating element are arranged in the housing coaxially to the axial outlet; and wherein the heating element includes a radial inlet opening via which the radial inlet of the housing is connected fluidly to the preheating chamber.

* * * * *